US005322027A

United States Patent [19]

Hashiride et al.

[11] Patent Number: 5,322,027

[45] Date of Patent: Jun. 21, 1994

[54] DRIVE UNIT FOR SEWING MACHINE

[75] Inventors: Tadaaki Hashiride, Okazaki; Yutaka Katou, Kariya, both of Japan

[73] Assignee: Aisin Seiki Kabushiki Kaisha, Kariya, Japan

[21] Appl. No.: 74,409

[22] Filed: Jun. 10, 1993

[30] Foreign Application Priority Data

Jun. 10, 1992 [JP] Japan ..... 4-150896

[51] Int. Cl.[5] ..... D05B 69/02; D05B 69/16

[52] U.S. Cl. ..... 112/220

[58] Field of Search ..... 112/220, 221, 185, 189, 112/80.43

[56] References Cited

U.S. PATENT DOCUMENTS 4,013,028 3/1977 Murakami ..... 112/220
4,467,737 8/1984 Breck, Jr. ..... 112/220 X
4,831,948 5/1989 Itoh ..... 112/80.43
5,088,429 2/1992 Kanegae ..... 112/220 X

*Primary Examiner*—Peter Nerbun
*Attorney, Agent, or Firm*—Oblon, Spivak, McClelland, Maier & Neustadt

[57] ABSTRACT

A sewing machine of a small size is enabled to deal with a fabric of an increased size to be sewn. A vertical spacing between an upper shaft mechanism and a lower shaft mechanism is adjustable. A need for a special control circuit which is designed for matching rotational positions of an upper and a lower shaft is dispensed with. At this end, a flexible wire 30 is used to connect an upper shaft unit 1 and a lower shaft unit 2 together. A single electric motor 10 is disposed within one of the upper and the lower shaft unit while a speed increasing mechanism 20 (or a speed reducing mechanism) is disposed in the other. An air cylinder 40 enables the vertical position of the upper shaft unit 1 to be adjustable.

4 Claims, 3 Drawing Sheets

DRIVE UNIT FOR SEWING MACHINE

BACKGROUND OF THE INVENTION

The invention relates to a drive unit for a sewing machine, which may be utilized in an industrial sewing machine or embroidery machine.

A prior art unit of this kind is disclosed, for example, in Japanese Patent Publication No. 44,351/1989.

A drive unit for a sewing machine generally comprises an upper shaft for driving a sewing needle for an elevating motion, and a lower shaft for driving a shuttle race in which a lower thread is loaded for rotation. Since it is necessary that the upper and the lower shaft be driven in exact synchronism, an electric motor, serving as a drive source, is connected to the upper shaft, and a connecting rod having a gear mounted thereon is disposed vertically so that gears on the connecting rod are effective to connect the upper and the lower shaft together, as disclosed in Japanese Patent Publication No. 44,351/1989.

When using a drive unit thus constructed, it is necessary to dispose the connecting rod at a location removed from a sewing needle or the like in order to avoid an interference of the connecting rod with a movement of a fabric being sewn or an embroidery frame. However, because the size of the entire sewing machine cannot be allowed to increase freely, the distance between the location of the connecting rod and the sewing needle is not so large in actuality. Accordingly, the fabric being sewn or the embroidery frame can be moved in a range which is limited by the location of the connecting rod, thus preventing a fabric of a larger size from being sewn.

The presence of the connecting rod also prevents the location of the upper and the lower shaft from being displaced. In other words, the vertical distance between the upper and the lower shaft cannot be changed, and hence the height of an article such as an embroidery frame which must be moved into and out of the space defined between the sewing needle and a throat plate is subject to a limitation by the length of the connecting rod, which means that an article having an increased height cannot be used.

To accommodate for this, Japanese Patent Publication No. 44,351/1989 utilizes independent electric motors for driving the upper and the lower shaft, respectively, thus dispensing with the connecting rod. The elimination of the connection between the upper and the lower shaft removes any interference with the movement of a fabric being sewn, and accordingly, a sewing machine of a small size is capable of sewing a large fabric.

However, the upper and the lower shaft must be driven in synchronism with each other, and accordingly when they are driven by independent motors, a complex control circuit is required in order to assure the synchronism, resulting in an increased cost of the sewing machine.

SUMMARY OF THE INVENTION

Accordingly, it is an object of the invention to enable a sewing machine of a small size to be adapted to a sewing of a large fabric while dispensing with a complex control circuit which has been required to achieve a synchronism between an upper and a lower shaft, thus allowing an inexpensive sewing machine to be provided.

The above object is accomplished in accordance with the invention by providing a drive unit for a sewing machine including an upper shaft connected to a needle bar mechanism which elevates a sewing needle, and a lower shaft connected to a shuttle race which supplies a lower thread. Specifically, the drive unit comprises drive source means (10) connected to one of the upper and the lower shaft, a speed changing mechanism (20) connected to the other of the upper and the lower shaft for doubling or halving a drive speed, and flexible connection wire means (30) for mechanically coupling the upper and the lower shaft together through the speed changing mechanism.

According to a further feature of the invention, elevating drive means (40) is disposed between an upper mechanism including the upper shaft, the needle bar mechanism and the sewing needle, and a fixed base which supports the upper mechanism.

It is to be noted that numerals appearing in parentheses refer to reference numerals used to designate certain elements used in an embodiment to be described later, but it should be understood that these elements of the invention are not limited to the specific construction shown in the embodiment.

In accordance with the invention, single drive source means is used for driving both a mechanism associated with the upper shaft and another mechanism associated with the lower shaft, and connection wire means is used to connect the both mechanisms. Since the connection wire means if flexible, it is capable of connecting the both mechanisms to transmit the drive from one of these mechanisms to the other while it assumes a flexed condition. Accordingly, a fabric being sewn of a large size can be easily sewn without increasing the overall size of the sewing machine, by employing connection wire means of relatively long length and disposing it in a manner to assume a roundabout way around a space where a fabric being sewn is disposed, by being laterally flexed.

The fact that the connection wire means is flexible allows the mechanism associated with the upper shaft, for example, to be elevated to change its position while it remains connected to the connection wire means, thus changing the vertical distance between the mechanisms associated with the upper and the lower shaft. This facilitates the engagement and disengagement of an embroidery frame having an increased size or a sewing operation of a relatively thick fabric being sewn.

According to another feature of the invention mentioned above, elevating drive means is installed between the mechanism associated with the upper shaft and the fixed base which supports it, and hence by driving it, the vertical distance between the mechanisms associated with the upper and the lower shaft can be adjusted in a simple manner.

Since it is necessary to drive the lower shaft at double the speed with which the upper shaft is driven, the drive from the connection wire means is transmitted to such driven side through the speed changing mechanism.

DETAILED DESCRIPTION OF PREFERRED EMBODIMENT

Figure 1:
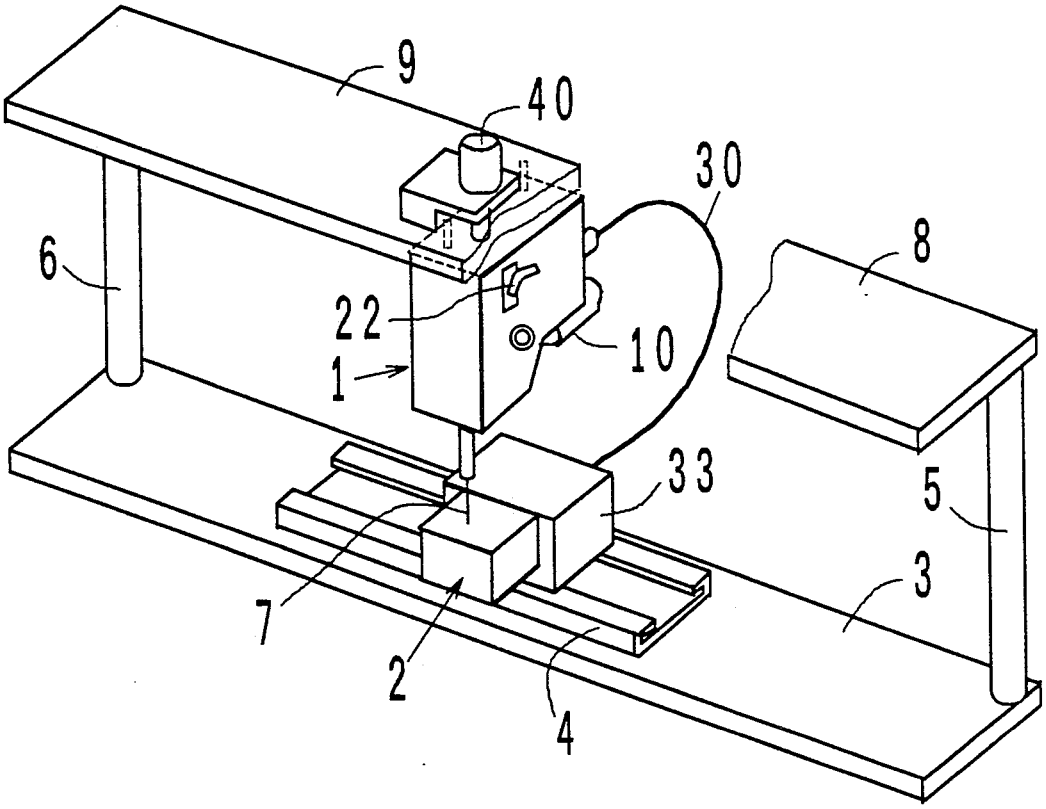
FIG. 1 is a perspective view showing the appearance of the entire sewing machine according to an embodiment.
Figure 2:
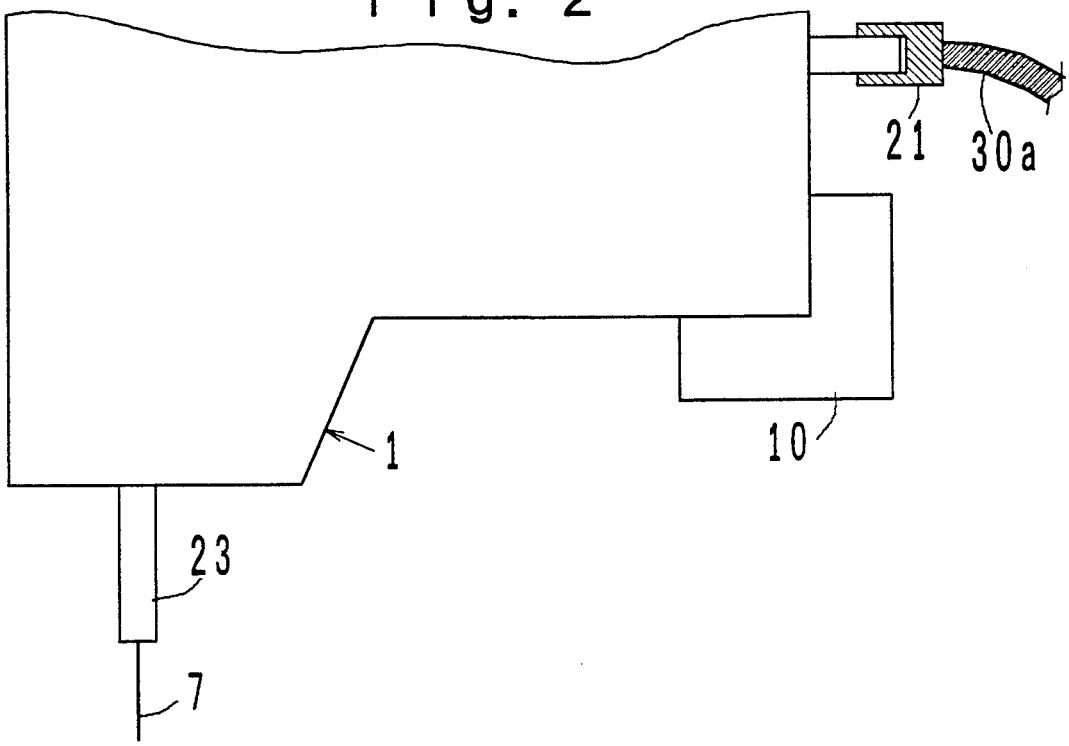
FIG. 2 is an enlarged, fragmentary section, principally illustrating a lower shaft unit 2 of the sewing machine shown in FIG. 1.
Figure 2:
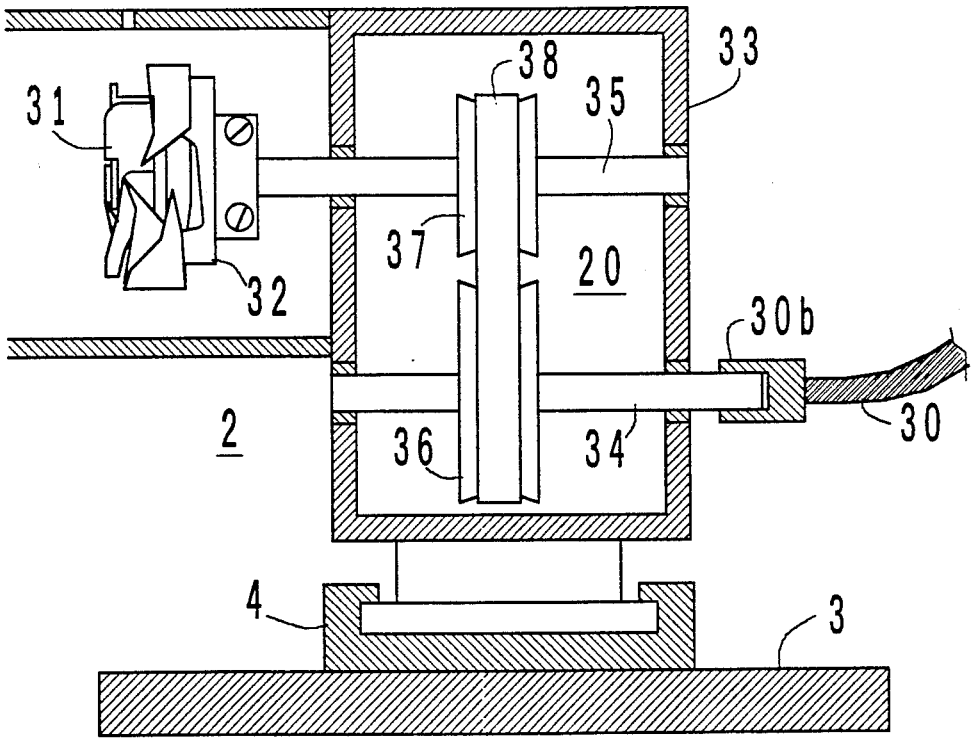
Figure 3:
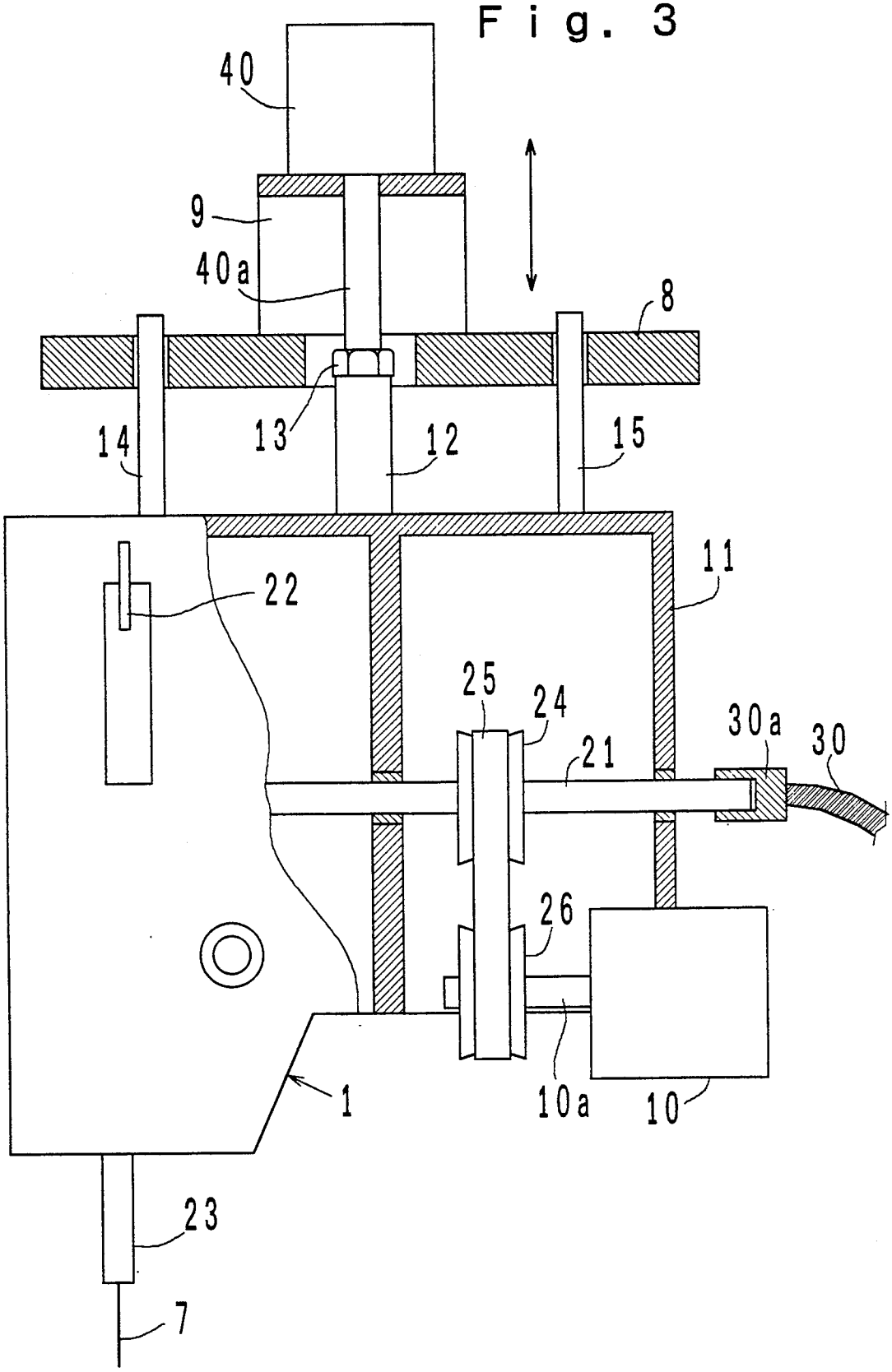
FIG. 3 is an enlarged, fragmentary section, principally illustrating an upper shaft unit 1 of the sewing machine shown in FIG. 1.

The appearance of an industrial sewing machine incorporating the invention is shown in FIG. 1, and the detail of drive mechanisms associated with a lower and an upper shaft are shown to an enlarged scale in FIGS. 2 and 3, respectively.

The sewing machine is generally divided into an upper shaft unit 1 and a lower shaft unit 2, as shown in FIG. 1, with the both units 1, 2 being connected together through a flexible wire 30. The lower shaft unit 2 is mounted on a guide rail 4 which is disposed on a bed 3, and is adjustable in position lengthwise of the rail. An arm 8 is fixedly mounted on top of stanchions 5, 6 located at the opposite ends of the bed 3. The upper shaft unit 1 is supported by the arm 8.

An electric motor 10, which serves as a drive source in a sewing machine, is contained in the upper shaft unit 1, and drives the upper shaft. The rotating drive from the upper shaft is transmitted to the lower shaft unit 2 through the flexible wire 30. In the present example, the flexible wire 30 comprises a number of relatively thin wires which are twisted together, and exhibits a sufficiently high mechanical strength while retaining the flexibility. Since the flexible wire 30 connects the upper shaft unit 1 and the lower shaft unit 2 together while it assumes a flexed condition, an extensive space is formed around a sewing needle 7, and there exists nothing which interferes with a movement of a fabric being sewn.

The fact that the flexible wire 30 is flexible and allows the vertical spacing between the upper shaft unit 1 and the lower shaft unit 2 to be adjusted while they are connected together by the flexible wire 30. In actuality, the upper shaft unit 1 is supported by the arm 8 while being vertically displaceable. An air cylinder 40 is interposed above the arm 8, and may be driven to elevate the upper shaft unit 1, thereby adjusting the spacing between the upper shaft unit 1 and the lower shaft unit 2. By increasing the spacing, the engagement or disengagement of a fabric being sewn with respect to the sewing machine is facilitated, and where the invention is applied to an embroidery machine, an embroidery frame of an increased size may be utilized.

Referring to FIG. 3, a bracket 9 is fixedly mounted on top of the arm 8 and fixedly carries the air cylinder 40. The air cylinder 40 includes a plunger 40*a*, which is coupled to a connecting rod 12 secured to a frame 11 of the upper shaft unit 1 by means of a nut 13. Thus, when the plunger 40*a* is driven in the direction of an arrow or in the vertical direction, the upper shaft unit 1 may be moved up and down accordingly. A pair of guide bars 14, 15 are disposed on the opposite sides of the connecting rod 12 in order to prevent any movement of the upper shaft unit 1 in directions other than the vertical direction.

The upper shaft unit 1 internally houses an upper shaft 21, to which is connected a needle bar mechanism including a thread take-up mechanism 22 and a needle bar 23, both of a known construction. Thus, when the upper shaft 21 is driven for rotation, the needle bar mechanism acts to drive the needle bar 23 and its connected sewing needle 7 for up and down movement. The upper shaft 21 is connected to a shaft 10*a* of the motor 10 through a pulley 24, a timing belt 25 and another pulley 26, and thus is driven for rotation as the motor 10 is set in motion. One end of the upper shaft 21 is coupled to a coupling 30*a* formed at one end of the flexible wire 30 with a serration.

Referring to FIG. 2, the lower shaft unit 2 will be described. Another coupling 30*b* is formed at the other end of the flexible wire 30, and is coupled to one end of an intermediate shaft 34 with a serration. The shaft 34 is disposed within a frame 23 of the lower shaft unit 2. A shuttle race 32 having a bobbin case 31 mounted therein is driven for rotation by a lower shaft 35 disposed within the frame 33. The lower shaft 35 is connected to the intermediate shaft 34 through a speed increasing mechanism 20. Specifically, the pulley 36 fixedly mounted on the intermediate shaft 34 is connected with a pulley 37 fixedly mounted on the lower shaft 35 by means of a timing belt 38, and a speed conversion is achieved by differential diameters of the pulleys 36 and 37. In this manner, the lower shaft 35 is driven for rotation at twice the speed of the flexible wire 30. It is to be noted that the lower shaft 35 rotates in the opposite direction from the upper shaft 21.

In the described embodiment, the vertical position of the upper shaft unit 1 is arranged to be changed by a drive from the air cylinder 40, but alternatively an electric motor may be used at this end, or the vertical position of the upper shaft unit 1 may be adjusted by a manual operation.

While the electric motor, which serves as a drive source, is disposed within the upper shaft unit 1 while the speed increasing mechanism 20 is arranged in the lower shaft unit 2 in the described embodiment, the electric motor may be disposed within the lower shaft unit and the speed increasing mechanism 20 may be replaced by a speed reducing mechanism arranged within the upper shaft unit so that the rotational speed of the flexible wire may be halved before being transmitted to the upper shaft.

As described above, flexible connection wire means is used to connect the mechanisms associated with the upper and the lower shaft in accordance with the invention. The connection wire means is capable of connecting the both mechanisms together while it remains in its flexed condition to transmit the drive from one of the mechanisms to the other. Accordingly, the connection wire means may be disposed to be laterally flexed so as to extend along a roundabout way around a space in which a fabric to be sewn is disposed, thereby allowing a larger fabric to be easily sewn without increasing the overall size of the sewing machine by utilizing an increased length for the connection wire means.

The fact that the connection wire means is flexible allows the upper shaft mechanism, for example, to be elevated to change its position while it remains connected by the connection wire means, thereby changing the vertical spacing between the mechanisms associated with the upper and the lower shaft. This facilitates the engagement or disengagement of an embroidery frame of an increased size or a sewing operation of a thick fabric, for example.

In addition, single drive source means is used to drive the mechanisms associated with the upper and the lower shaft in accordance with the invention, dispensing with the need for a complex control circuit in order to achieve a synchronism between the phases of rotation of both the upper and the lower shaft, thus providing an inexpensive sewing machine.

According to another feature of the invention, an elevating drive means is installed between the upper mechanism and a fixed base which supports it, and can be driven to adjust the vertical spacing between the mechanisms associated with the upper and the lower shaft in a simple manner.

What is claimed is:

1. A drive unit for a sewing machine including an upper shaft connected to a needle bar mechanism which elevates a sewing needle and a lower shaft connected to a shuttle race which is used to supply a lower thread, the drive unit comprising:

an adjustable support for supporting at least one of said upper shaft and said lower shaft such that a spacing between said upper shaft and said lower shaft is adjustable;

a drive source connected to one of the upper and the lower shaft;

a speed changing mechanism connected to the other of the upper and the lower shaft for doubling or halving the drive speed;

and flexible connection wire for mechanically connecting the upper and the lower shaft together through the speed changing mechanism.

2. A drive unit according to claim 1, wherein said adjustable support supports said upper shaft and comprises elevating drive means for raising and lowering an upper shaft unit, and a fixed base which supports an upper mechanism including said upper shaft, said needle bar mechanism and said sewing needle, said elevating drive means being connected to said upper mechanism.

3. A drive unit according to claim 2, the elevating drive means including an air cylinder.

4. A drive unit according to claim 1, wherein ends of said flexible connection wire are connected coaxially with said upper and lower shafts such that said flexible connection wire is rotated about a longitudinal axis thereof during rotation of the upper and lower shafts.

* * * * *